US009309636B2

(12) United States Patent
Wyllie

(10) Patent No.: US 9,309,636 B2
(45) Date of Patent: Apr. 12, 2016

(54) ROCKFALL BARRIER

(76) Inventor: Duncan C. Wyllie, North Vancouver (CA)

( * ) Notice: Subject to any disclaimer, the term of this patent is extended or adjusted under 35 U.S.C. 154(b) by 247 days.

(21) Appl. No.: 13/560,704

(22) Filed: Jul. 27, 2012

(65) Prior Publication Data

US 2014/0027695 A1 Jan. 30, 2014

(51) Int. Cl.
*E01F 7/04* (2006.01)

(52) U.S. Cl.
CPC ..... *E01F 7/045* (2013.01)

(58) Field of Classification Search
CPC ..... E01F 7/04; E01F 7/045; E05D 11/06; E05D 11/087
USPC ..... 256/12.5, 1, 35; 16/334, 336, 342
See application file for complete search history.

(56) References Cited

U.S. PATENT DOCUMENTS

| | | | | |
|---|---|---|---|---|
| 2,646,257 | A * | 7/1953 | Krume | 256/12.5 |
| 3,141,639 | A * | 7/1964 | Klein | 244/114 B |
| 3,180,446 | A * | 4/1965 | Wenger | 181/30 |
| 4,727,994 | A * | 3/1988 | Beaulieu | 211/198 |
| 4,819,915 | A | 4/1989 | Cargnel | |
| 5,078,284 | A * | 1/1992 | Pirkl | A47F 5/105 211/195 |
| 5,299,781 | A | 4/1994 | Barrett | |
| 7,028,990 | B2 * | 4/2006 | Shorey et al. | 256/1 |
| 7,440,782 | B2 * | 10/2008 | Cha | 455/575.3 |
| 8,646,153 | B2 * | 2/2014 | Nagami | 16/334 |
| 2004/0041139 | A1 * | 3/2004 | Rambaud | 256/12.5 |
| 2006/0059661 | A1 * | 3/2006 | Higano et al. | 16/366 |
| 2010/0031473 | A1 * | 2/2010 | Hayahi | 16/297 |
| 2011/0023271 | A1 * | 2/2011 | Shen | 16/334 |

FOREIGN PATENT DOCUMENTS

| | | | |
|---|---|---|---|
| EP | 1130166 | A2 | 9/2001 |
| JP | 2003239224 | A | 8/2003 |
| JP | 2003-321809 | A | 11/2003 |
| JP | 2003321808 | A | 11/2003 |
| KR | 100629909 | B1 | 9/2006 |
| KR | 100985799 | B1 | 10/2010 |

OTHER PUBLICATIONS

Badger, T. C., et al., "Structural design of a hybrid drapery system", Interdisciplinary Rockfall Workshop 2011, Innsbruck, Austria, pp. 1-2.

Von Boetticher, A., et al., "Modelling flexible wire netting applied to rock fall attenuating systems", Interdisciplinary Rockfall Workshop 2011, Innsbruck, Austria, pp. 1-2.

* cited by examiner

*Primary Examiner* — Michael P Ferguson
*Assistant Examiner* — Jonathan Masinick
(74) *Attorney, Agent, or Firm* — Oyen Wiggs Green & Mutala LLP

(57) ABSTRACT

A rock fall barrier including a plurality of support posts and a deformable net spanning the plurality of support posts. Each support post includes: a base fixed to a sloped surface; a first arm pivotally coupled to the base at a first hinge; a first hinge brake for providing friction at the first hinge to provide controlled resistance against pivotal rotation of the first arm relative to the base; a second arm pivotally coupled to the first arm at a second hinge; and a second hinge brake for providing friction at the second hinge to provide controlled resistance against relative pivotal rotation between the first arm and the second arm. A guy wire system is attached to the distal end of each support post on one end and anchored to the sloped surface on the other end. The guy wire system includes upper guy wires having cable brakes.

4 Claims, 6 Drawing Sheets

ROCKFALL BARRIER

TECHNICAL FIELD

The present invention relates to barriers for slowing and stopping rocks falling down a sloped surface.

BACKGROUND

Over time, environmental and human factors may cause rocks to become loose. If these rocks are on a sloped surface, such as a cliff or a mountainside, the rocks may be freed and fall down the sloped surface. This phenomenon is known as rockfall. Rockfalls may be dangerous if the sloped surface is nearby an area with human activity. For example, transportation infrastructure such as roadways and train tracks built close to sloped surfaces by necessity are vulnerable to rockfall damage. Rockfalls can also damage road vehicles and trains, cause traffic and train delays, and even result in injury or death to individuals in the vicinity of the rockfall.

Rockfall barriers intercept rocks falling down slopes and dissipate their kinetic energy before they can pose a danger to human activity. Conventional rockfall barriers typically include a deformable mesh net supported by two or more rigid posts secured in a perpendicular manner to the slope. The posts may be stayed with guy wires provided with cable brakes of various configurations. Impact by falling rock with energy up to the design energy limit of the barrier may be absorbed by deformation of the net and activation of the cable brakes. Impact with the net of rocks with energies greater than the design energy can result in damage or destruction of the barrier.

Rockfall barriers with improved energy absorbing capabilities are desirable.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention relates to a support post for a rockfall barrier. The support post includes a base; a first arm pivotally coupled to the base at a first hinge; a first hinge brake for providing friction at the first hinge to provide controlled resistance against pivotal rotation of the first arm relative to the base; a second arm pivotally coupled to the first arm at a second hinge; and a second hinge brake for providing friction at the second hinge to provide controlled resistance against relative pivotal rotation between the first arm and the second arm.

The first arm may be configurable at a 0°-90° angle downslope to the normal of a sloped surface and the second arm may be configurable at a 0°-90° angle upslope to the normal to the sloped surface, wherein the first arm and the second arm form a concavity facing an upslope direction. The first arm may be configurable at a 0°-45° angle downslope to the normal of a sloped surface and the second aim may be configurable at a 0°-30° angle upslope to the normal to the sloped surface. The second arm may be longer than the first arm. The ratio between the lengths of the second arm and the first arm may range from about 2:1 to 4:1. The first hinge brake may include a first pair of friction plates and the second hinge brake may include a second pair of friction plates. The first and second pairs of friction plates may include stops to prevent the support post from collapsing in the upslope direction.

Another aspect of the invention relates to a rock fall barrier. The barrier includes a plurality of support posts, each support post including: a base fixed to a sloped surface; a first arm pivotally coupled to the base at a first hinge; a first hinge brake for providing friction at the first hinge to provide controlled resistance against pivotal rotation of the first arm relative to the base; a second arm pivotally coupled to the first arm at a second hinge; and a second hinge brake for providing friction at the second hinge to provide controlled resistance against relative pivotal rotation between the first arm and the second arm; and a deformable net spanning the plurality of support posts.

The barrier may include at least one guy wire attached at one end to a distal end of one of the plurality of support posts and anchored at the other end to the sloped surfaced. The guy wires incorporate cable brakes.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

The term "proximal" with respect to the foundation and the support posts in this disclosure means closer to the sloped surface to which the rockfall barrier is secured. The term "distal" means further away from the sloped surface to which the rockfall barrier is secured. The terms "rock" and "rocks" in this disclosure means rocks, boulders, and other objects that may fall down a sloped surface and pose a hazard to human activity. The terms "fall", "falls" and "falling" in this disclosure means falling, sliding, tumbling, rolling, and the like.

Figure 1:
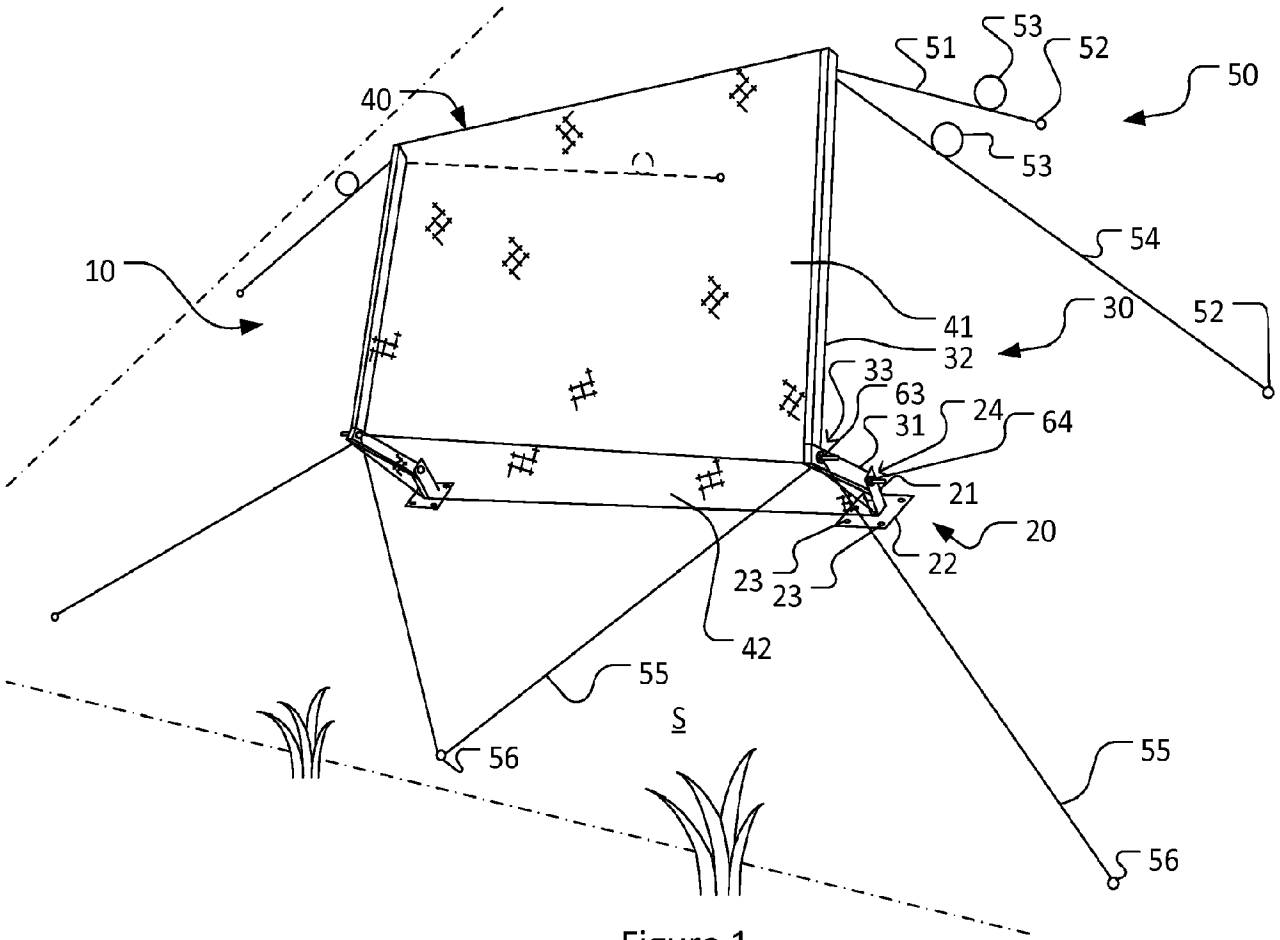
FIG. 1 is a perspective view of a rockfall barrier according to an embodiment of the invention.

FIG. 1 shows a rockfall barrier 10 according to an embodiment of the invention. Barrier 10 is secured to a sloped surface S. Barrier 10 includes a plurality of support posts 30. A net 40 for catching falling rocks spans across support posts 30.

Each support post 30 is coupled to a base 20. Each base 20 includes a distal portion 21 and a proximal portion 22. Proximal portion 22 of base 20 may be secured to sloped surface S by conventional means. For example, where sloped surface S is solid rock or other solid surface, anchoring bolts 23 may be drilled into the surface to secure proximal portion 22 directly to sloped surface S. Where sloped surface S is a less stable material, a concrete anchoring block (not shown) may be embedded into the surface, with proximal portion 22 secured thereto by anchoring bolts 23.

Each support post 30 includes a first arm 31 and a second arm 32. First arm 31 and second arm 32 may be constructed of steel or other suitable high strength material. Base 20, first arm 31, and second arm 32 are articulated. In particular, first arm 31 is pivotally coupled to distal portion 21 of base 20 at a first hinge 24, and second arm 32 is pivotally coupled to first arm 31 at a second hinge 33. In some embodiments, second arm 32 is longer in length than first arm 31.

Figure 3A:
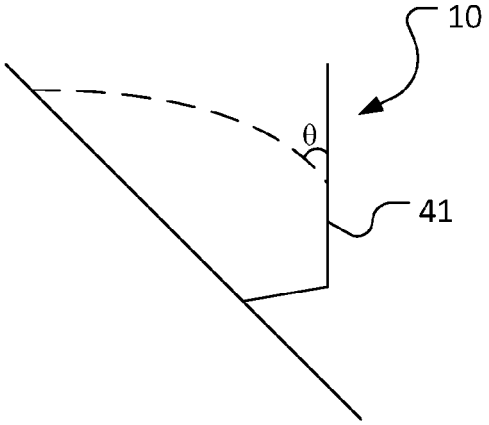
FIG. 3A is a schematic side elevation view of the rockfall barrier shown in FIG. 1.

In some example embodiments, the ratio of the length of second arm 32 to the length of first arm 31 ranges from about 2:1 to about 4:1, and may be about 3:1. Arm 32 is longer than arm 31 so that, for rocks impacting the upper part of the barrier 41, the impact angle θ is less than 90° (as shown in FIG. 3A). An impact angle, θ, less than 90° reduces the spin of a falling rock impacting the barrier and directs the falling rock toward the base of the barrier. In some embodiments, first arm 31 may be fixedly coupled to or integral with base 20, i.e., with articulation only between first arm 31 and second arm 32. In further embodiments, second arm 32 may be fixedly coupled to first arm 32, i.e., with articulation only between first arm 32 and base 20. In yet other embodiments, more than two articulated arms, for example three articulated arms, may be provided.

First hinge 24 is provided with a first hinge brake 64 that provides resistance against relative pivotal rotation between base 20 and first arm 31. Similarly, second hinge 33 is provided with a second hinge brake 63 that provides resistance against relative pivotal rotation between first arm 31 and second arm 32. In some embodiments, the degree of braking or resistance provided by first hinge brake 64 and second hinge brake 63 is controlled. In some embodiments, first hinge brake 64 and second hinge brake 63 may be embodied by employing contact surfaces with high coefficients of friction. In other embodiments, first hinge brake 64 and second hinge brake 63 may additionally or alternatively include springs, elastics, hydraulics, friction plates and the like provided at or adjacent to first hinge 24 and second hinge 33.

Net 40 includes an upper portion 41 and a lower portion 42. Upper portion 41 and lower portion 42 may be continuous or separate. The top of net 40 may be secured to distal ends of second arms 32. The bottom of net 40 may be secured to the first members 21 such that no gap exists between the base of net 42 and slope S. Net 40 may be a chain-link fence, a cable net, a ringnet, or other suitable net for catching rocks as is known to persons skilled in the art.

A guy wire system 50 is attached to support posts 30. First top guy wires 51 and second top guy wires 54 of guy wire system 50 are attached on one end to the distal ends of second arms 32 and attached on the other end to sloped surface S by anchors 52. Cable brakes 53 may be provided on first top guy wires 51, second top guy wires 54 or both. Cable brakes 53 may be wire loops, springs or other suitable energy absorbing components as is known to persons skilled in the art. Bottom guy wires 55 are attached on one end to the distal end of first arms 31 using shackles, cable clamps and other suitable methods as are known to persons skilled in the art, and attached on the other end to sloped surface S by anchors 56.

In some embodiments, the energy absorbing characteristics of the hinge brakes 24 and 33 and the cable brakes 53 may be similar such that the rock fall impact energy is absorbed by the both types of brakes concurrently during the duration of the impact.

Figure 2:
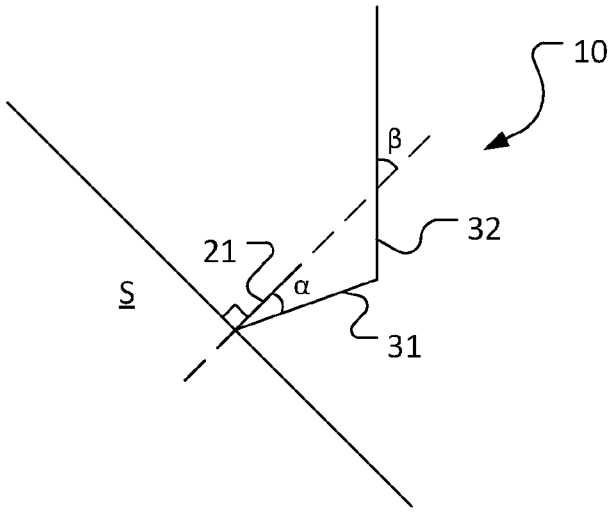
FIG. 2 is a schematic side elevation view of the rockfall barrier shown in FIG. 1.

As shown in FIG. 2, first arm 31 is initially positioned in the downslope direction at an angle α to the normal to the sloped surface. In some embodiments, angle α may range from 0°-90°, or 0°-45°, or be about 45°. Second arm 32 is initially positioned in the upslope direction at an angle β to the normal to the sloped surface. In some embodiments, angle β may range from 0°-90°, or 0°-30°, or be about 30°. Thus, first arm 31 and second arm 32 of support post 30 are initially positioned in a concave arrangement with the concavity facing upslope. Stops (not shown) may be incorporated at hinges 24 and 33, arms 31 and 32, and/or base 21 to prevent over rotation of arms 31 and 32 into sloped surface S in the upslope or downslope direction.

Figure 3B:
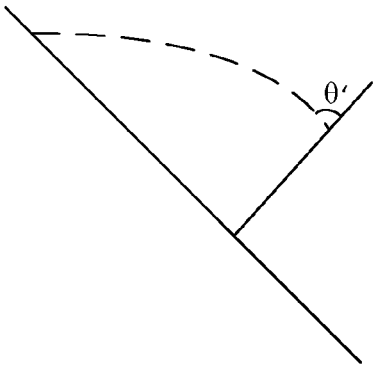
FIG. 3B is a schematic side elevation view of a known rockfall barrier.

FIGS. 3A and 3B illustrate the difference between how rocks impact upper portion 41 of net 40 of barrier 10 and an upper portion of a net of a conventional barrier, respectively. Rocks impact barrier 10 at angle θ relative to the net, and impact the conventional barrier at angle θ' relative to the net. Angle θ is smaller than angle θ' due to the upslope inclination of upper portion 41 of barrier 10. Impact of the rock with upper portion 41 at angle θ less than 90° imparts both shear forces and normal forces between the rock and net 40 of barrier 10 due to friction at the contact point. The shear and normal components of the force, together with the flexibility of net 40, reduce the translational and rotational velocities of the rock. At this reduced velocity, gravity will direct the motion of the rock away from the net and towards the ground. The combination of simultaneous action of the hinge brakes 24 and 33, and the cable brakes 53, together with the reduction in velocity produced by the impact angle θ being less than 90° will minimize the forces generated on the components of barrier 10 during the rock impact.

In contrast, impact of the rock with the net at the larger angle θ' imparts predominantly normal forces in the net and results in the generation of large forces concentrated in a small area of the net, that are higher than those generated by impacts at angle θ.

Figure 4:
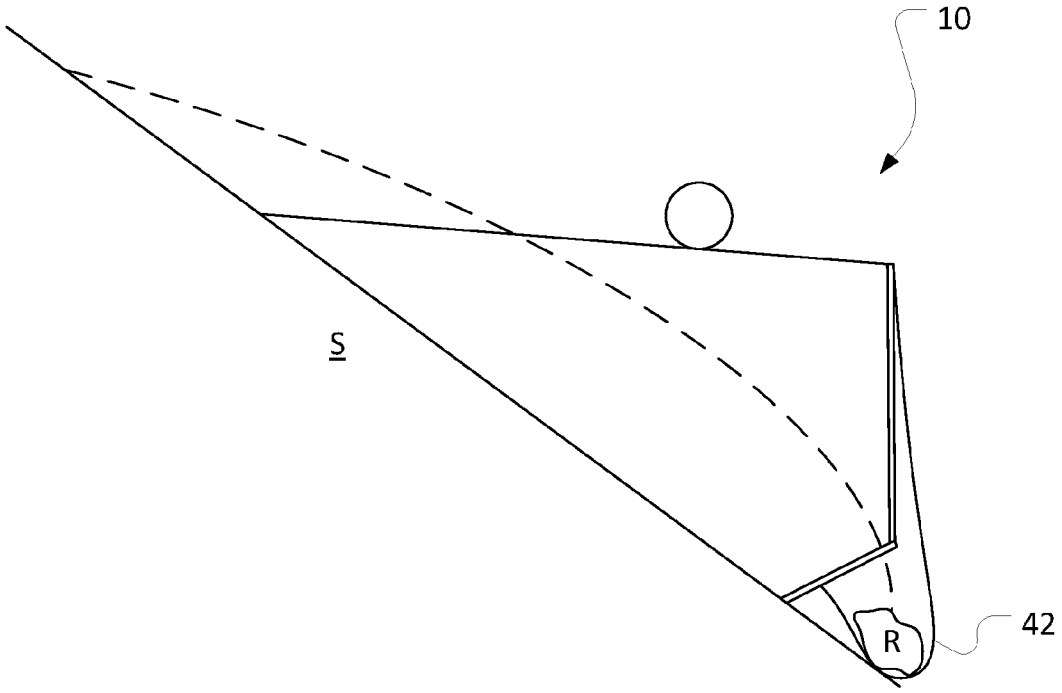
FIG. 4 is a side elevation view of the rockfall barrier shown in FIG. 1 catching a low falling rock.

Rocks that collide with lower portion 42 of barrier 10 will cause lower portion 42 of net 40 to deform and impact the ground, thereby absorbing the energy of the rocks, as illustrated in FIG. 4.

Figure 5:
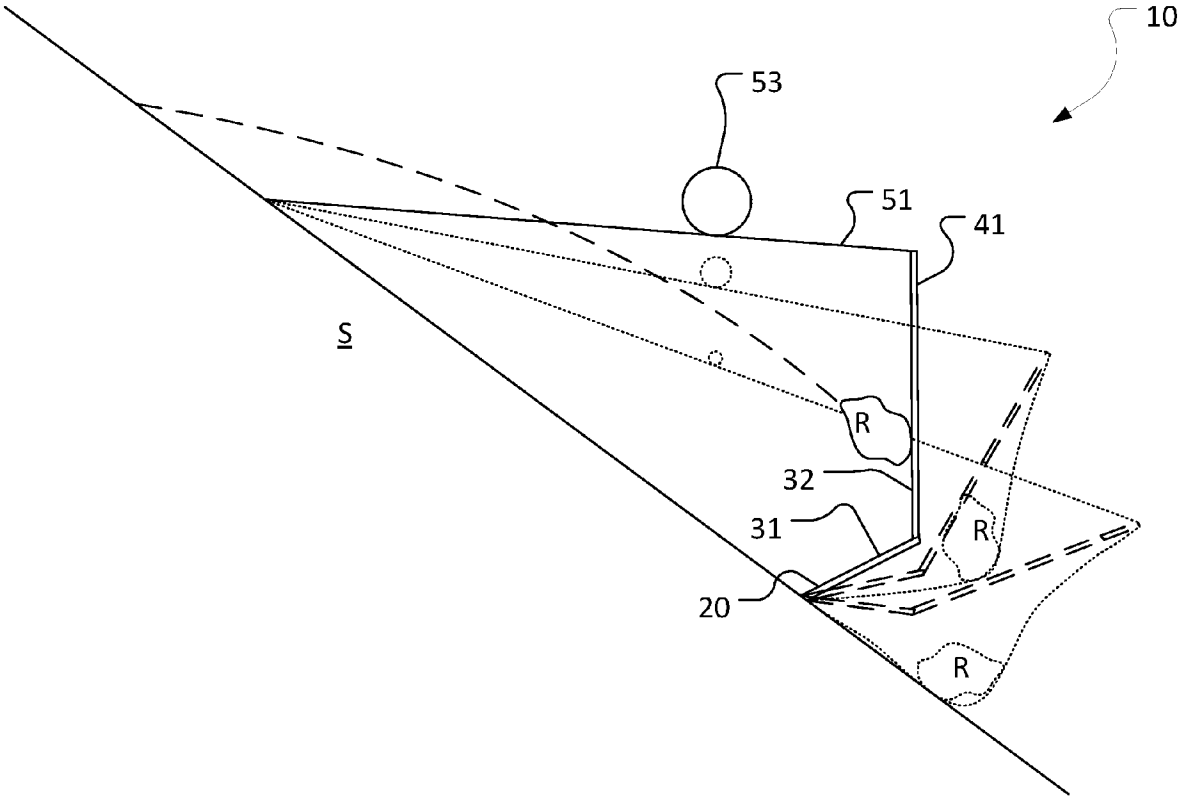
FIG. 5 is a side elevation view of the rockfall barrier shown in FIG. 1 catching a high falling rock. The portions in solid lines show the barrier at an initial time point and the portions in stippled lines show the barrier at later time points.

In operation, as shown in FIG. 5, when a rock R impacts rockfall barrier 10, rock R is caught by net 40. Net 40 deforms in the downslope direction, causing support posts 30 to deflect in the downslope direction at hinges 24 and 33. Deflection at hinges 24 and 33 engages first hinge brake 64 and second hinge brake 63 respectively. The deflection of support posts 30 also engages cable brakes 53 provided on top guy wires 51 and 54. Thus, the kinetic energy of rock R is distributively absorbed by net 40, first brake 64 and second brake 63, and friction brakes 53 of top guy wires 51 and 54, reducing the momentum of rock R and bringing rock R to rest.

When rocks impact rockfall barriers, the reduction of momentum is related to the magnitude of the forces generated in the barrier, and the time duration that the forces are exerted. The momentum that is absorbed by the barrier is correlated to the area under the force-time curve as determined by integration, an example of which is shown in FIG. 6.

Figure 6:
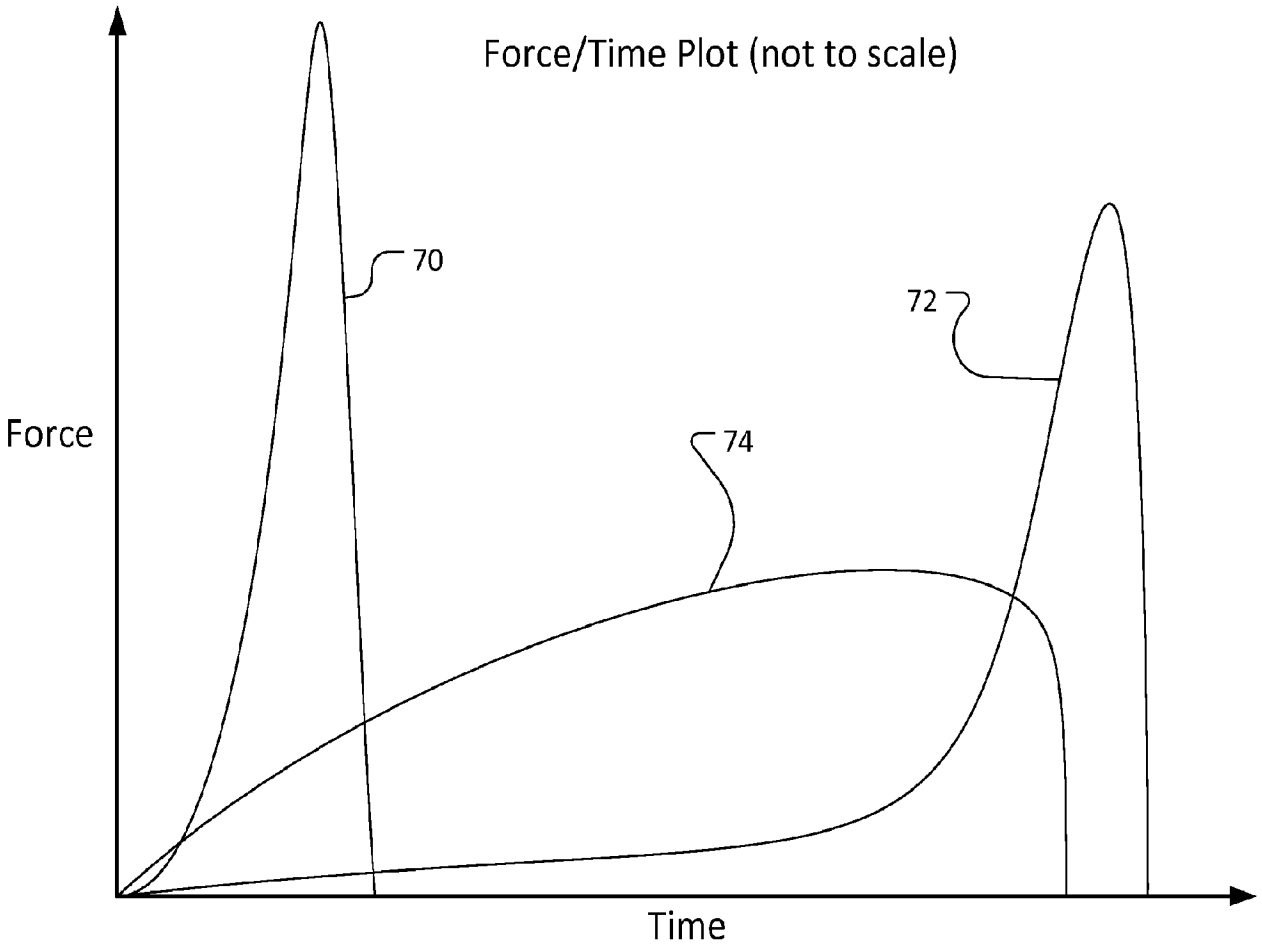
FIG. 6 is a force-time graph (not to scale) illustrating the momentum reduced by various types of rockfall barriers including a rockfall barrier according to an embodiment of the invention.

The relationships between force and time during impact of different types of barriers are represented approximately by a power curve with an exponent greater than 1 , as shown in FIG. 6. Where the barriers are rigid, the rockfall impact forces generated in the barrier act for very short durations and have large magnitudes as the impact energy is absorbed over a short time, as represented by the curve identified by reference numeral 70 in FIG. 6. Impacts with these types of barriers, such as rigid concrete walls, may lead to the damage or the destruction of such barriers.

Where the barriers are highly flexible, the duration of the impact will be longer than with a rigid barrier and significant deformation of the barrier takes place during the impact, as represented by the curve identified by reference numeral 72 in FIG.6. During the initial portion of the impact, deformation will occur, but the forces generated in the barrier will be small and little momentum will be absorbed. In the final portion of the impact process, the deformation is limited and the major portion of the impact momentum is absorbed during this time.

Rockfall barriers according to the invention, such as example embodiment barrier 10, are flexible-stiff structures that can deform, but provide resistance to the deformation due to the combined action of the flexible net 40, hinge brakes 63 and 64, and cable brakes 53. As illustrated by the curve identified by reference numeral 74 in FIG. 6, the impact energy is absorbed in a generally uniform manner throughout the duration of the contact between the rock and the net. The relationship between force and time during impact is represented approximately by a power curve with an exponent between 0 and 1. Integration of the area under the force-time curve is correlated to the momentum absorbed by the net, and shows that the maximum force generated in the net is significantly less than that for both rigid barriers and highly flexible barriers. The uniform absorption of momentum is achieved by selecting force—displacement properties for each of the flexible net 40, hinge brakes 33 and 64, and cable brakes 53 so that each component significantly contributes to the absorption of momentum. In some embodiments, the force-displacement properties for each of the net, hinge brakes and cable brakes may be selected to be about equal. This property is achieved by testing each component to measure the force required to cause displacement, knowing that the friction coefficient is independent of velocity so that laboratory tests are applicable to high velocity displacement that occurs during rock fall impact.

The force—displacement property of barrier component nets 41 and 42, hinge brakes 33 and 64, and cable brakes 54 are adjustable to suit the design impact energy of the barrier. That is, the force required to displace the net and brakes increases as the design energy of the barrier increases.

When initially setting up barrier 10 or repositioning barrier 10 after a rock impact with sufficient energy to displace the barrier, the force—displacement property of hinge brakes 63 and 64 can be reduced to facilitate setting the angles of arms 31 and 32.

Figure 7:
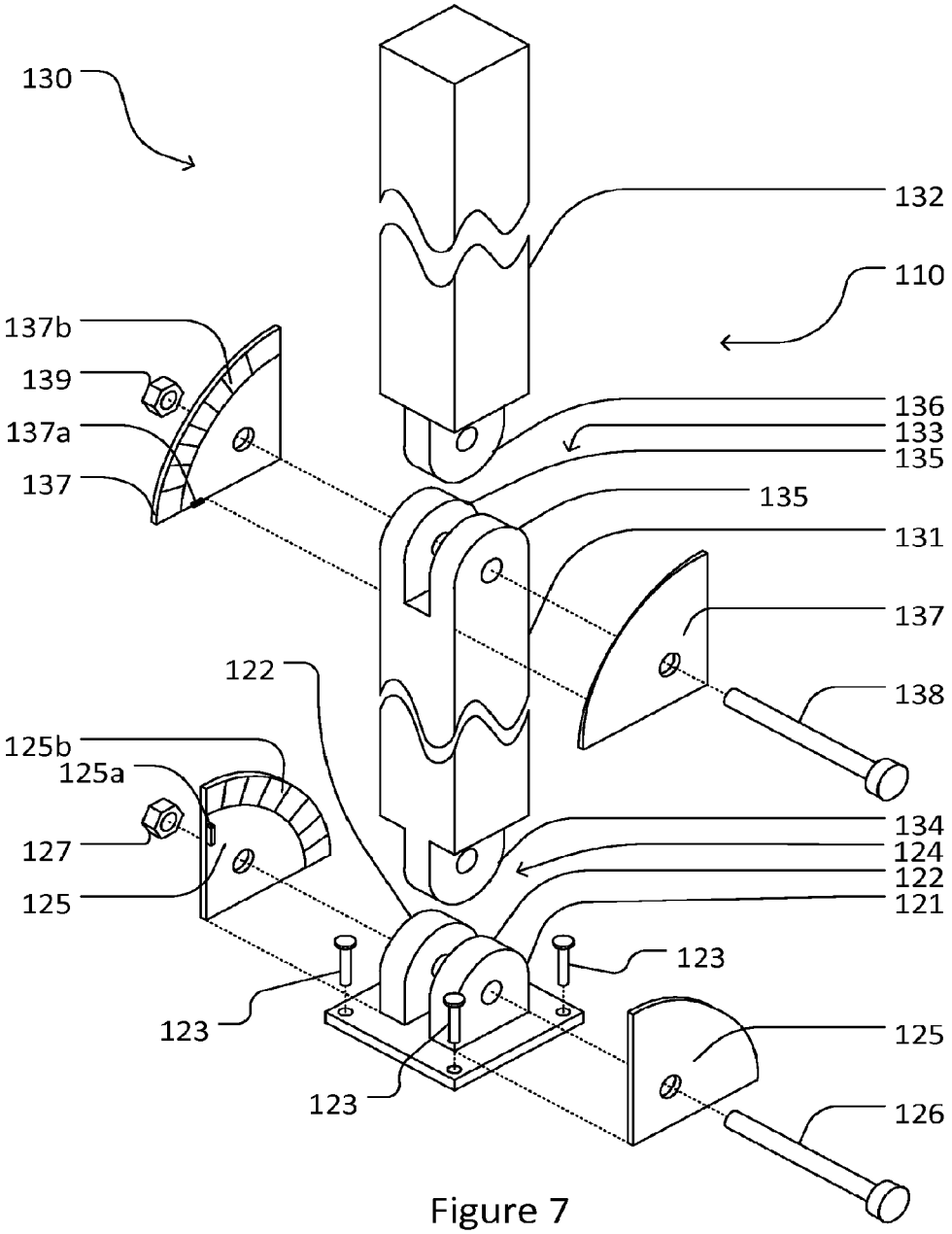
FIG. 7 is an exploded isometric view of a support post of a rockfall barrier according to an embodiment of the invention.

FIG. 7 illustrates a rockfall barrier 110 according to another embodiment of the invention. Base 121 of barrier 110 is secured directly to strong rock on sloped surface S by bolts 123. In some embodiments, base 121 is secured to a concrete block within a recess in a sloped surface. Distal portion of base 121 includes knuckles 122. Support post 130 of barrier 110 comprises a first arm 131 and a second arm 132. A proximal end of first arm 131 includes a knuckle 134 complementary to knuckles 122 of base 121. Knuckles 122 and 134 are pivotally coupled by a bolt 126 and a nut 127 to form a first hinge 124. A distal end of first arm 131 includes knuckles 135 which are complementary to knuckle 136 on a proximal end of second arm 132. Knuckles 135 and 136 are pivotally coupled by a bolt 138 and a nut 139 to form a second hinge 133. In other embodiments, first hinge 124 and second hinge 133 may be coupled by other suitable means that provide pivotal coupling between base 121 and first arm 131 and between first arm 131 and second arm 132.

Barrier 110 includes friction plates 125 and 137 for providing frictional resistance to rotation at hinges 124 and 133, respectively, and are components of first and second hinge brakes. Inside faces of friction plates 125 and 137 include textured surface portions **125*b* and 137*b* to achieve the desired coefficient of friction. The amount of frictional resistance may be controlled by tightening or loosening nuts 127 and 139, and bolts 126 and 138. In some embodiments, friction plates 125 and 137 may be substantially quadrant-shaped. In some embodiments, friction plates 125 and 137 may be respectively secured to base 121 (to provide controlled friction between the inside faces of friction plates 125 and the outside faces of first arm 131) and first arm 131 (to provide controlled friction between the inside faces of friction plates 137 and the outside faces of second arm 132). In some embodiments, friction plates 125 may be secured to each other across first hinge 124 (to provide controlled friction between the inside faces of friction plates 125 and the outside faces of first arm 131) and friction plates 137 may be secured to each other across second hinge 133 (to provide controlled friction between the inside faces of friction plates 137 and the outside faces of second arm 132**).

In some embodiments, the inside face of friction plates 125 include stop **125*a*, which prevents first arm 131 from over-rotating in the upslope direction. Similarly, the inside face of friction plates 137 may include stop 137*a* which prevents second arm 132 from over-rotating in the upslope direction. Stops 125*a* and 137*a* may be positioned to predetermine the range of relative rotation of first arm 131 and second arm 132**.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A rockfall barrier comprising:

a plurality of support posts, each support post comprising:

a base fixed to a sloped surface;

a first arm connected to the base;

a second arm connected to the first arm, wherein the second arm is a continuous, non-hinged arm, the second arm is longer than the first arm, and the second arm is not connected to any arm other than the first arm; and wherein the first arm is at a 0°-90° angle to the normal of the sloped surface and the second arm is at a 0°-90° angle to the normal to the sloped surface, wherein the first arm and the second arm form a concavity facing an upslope direction; and a deformable net, capable of sustaining multiple rock fall impacts, spanning the plurality of support posts and at least one guy wire attached at one end to a distal end of one of the plurality of support posts and anchored at the other end to the sloped surface;

wherein the first arm is pivotally coupled to the base at a first hinge comprising a first hinge brake, the first hinge brake comprising a first pair of friction surfaces connected to or integral with the base that frictionally engage a second pair of friction surfaces connected to or integral with the first arm to provide controlled relative pivotal rotation between the first arm and the base;

wherein the second arm is pivotally coupled to the first arm at a second hinge comprising a second hinge brake, the second hinge brake comprising a third pair of friction surfaces connected to or integral with the second arm that frictionally engage a fourth pair of friction surfaces connected to or integral with the first arm to provide controlled relative pivotal rotation between the second arm and the first arm.

2. The rockfall barrier of claim 1 wherein the at least one guy wire comprises a cable brake.

3. The rockfall barrier of claim 2 wherein the ratio between the lengths of the second arm and the first arm ranges from about 2:1 to 4:1.

4. The rockfall barrier of claim 3 wherein the first arm is configurable at a 0°-45° angle to the normal to a sloped surface and the second arm is configurable at a 0°-30° angle to the normal to a sloped surface.

* * * * *